US010526803B2

(12) United States Patent
Franceschino

(10) Patent No.: US 10,526,803 B2
(45) Date of Patent: Jan. 7, 2020

(54) MONOPOLE PLATFORM UPPER RAIL SUPPORT

(71) Applicant: Sabre Communications Corporation, Sioux City, IA (US)

(72) Inventor: Carlo Umberto Franceschino, London (CA)

(73) Assignee: Sabre Communications Corporation, Sioux City, IA (US)

( * ) Notice: Subject to any disclaimer, the term of this patent is extended or adjusted under 35 U.S.C. 154(b) by 0 days.

(21) Appl. No.: 15/604,229

(22) Filed: May 24, 2017

(65) Prior Publication Data

US 2017/0343156 A1 Nov. 30, 2017

Related U.S. Application Data

(60) Provisional application No. 62/343,330, filed on May 31, 2016.

(51) Int. Cl.
*E04G 5/14* (2006.01)
*E04G 5/06* (2006.01)

(52) U.S. Cl.
CPC ..... *E04G 5/067* (2013.01)

(58) Field of Classification Search
CPC ..... F16M 13/02; E04G 5/067; E04G 3/00; E04G 3/305; E21B 15/00; E04H 12/00; H01Q 1/1242
See application file for complete search history.

(56) References Cited

U.S. PATENT DOCUMENTS 5,467,955 A * 11/1995 Beyersmith ..... H01Q 1/1242 248/219.3
5,787,673 A * 8/1998 Noble ..... E04H 12/085 343/890
5,954,305 A * 9/1999 Calabro ..... H01Q 1/1242 248/219.4

(Continued)

OTHER PUBLICATIONS

"Accessories and Steel Products Portfolio—Rev B—2014", Steelhead Metal & Fab. LLC, (2014), 3 pgs.

(Continued)

*Primary Examiner* — Colleen M Chavchavadze
*Assistant Examiner* — Shiref M Mekhaeil
(74) *Attorney, Agent, or Firm* — Schwegman Lundberg & Woessner, P.A.

(57) ABSTRACT

A platform assembly, such as for a utility or communications monopole, can include a central mounting bracket, such as can be configured for mounting about a monopole. One or more or at least three platforms can extend laterally from the central mounting bracket. One or more or at least three lower rails can extend between adjacent pairs of the platforms. One or more or at least three upper rails can be located above respective lower rails. A plurality of vertical mounting pipes can interconnect respective upper rails to corresponding lower rails. Such vertical mounting pipes can support the respective upper rails with respect to the corresponding lower rails. One or more or at least three corner connection plates can extend between adjacent upper rails. A vertical support pedestal can connect at least one of the corner connection plates to an underlying one of the one or more or at least three platforms.

6 Claims, 3 Drawing Sheets

(56) References Cited

U.S. PATENT DOCUMENTS

| | | | | |
|---|---|---|---|---|
| 6,052,092 | A * | 4/2000 | Davis | H01Q 1/1242 343/757 |
| 6,088,002 | A * | 7/2000 | Johnson | H01Q 19/108 343/799 |
| 2002/0053996 | A1* | 5/2002 | Ianello | H01Q 1/1242 343/890 |
| 2004/0011592 | A1* | 1/2004 | Lee | E04G 1/36 182/187 |
| 2004/0032375 | A1* | 2/2004 | Ianello | E04H 12/10 343/890 |
| 2011/0279347 | A1* | 11/2011 | Pass | H01Q 1/1242 343/890 |
| 2013/0145718 | A1* | 6/2013 | Bryant, Jr. | E21B 15/00 52/650.3 |
| 2015/0053503 | A1* | 2/2015 | Richey | A01M 31/02 182/187 |
| 2018/0051474 | A1* | 2/2018 | Ledet | E04G 3/24 |
| 2018/0051521 | A1* | 2/2018 | Ledet | E21B 15/00 |

OTHER PUBLICATIONS

"Catalog 46", Valmont Communications, (2003), 3 pgs.
"Monopole Applications—Heavy Duty Mounts for Extreme Loading", Connect-it Wireless Components, (2015), 3 pgs.
"MTS Wireless Components—Antenna Mounting and Site Related Products", Andrew Steel Products, (2005), 4 pgs.
"Product Catalog 3rd Edition", Sabre Site Solutions, (2005), 9 pgs.
"Wireless Components and Site Accessories", Sabre Site Solutions, (2010), 2 pgs.

* cited by examiner

MONOPOLE PLATFORM UPPER RAIL SUPPORT

CLAIM OF PRIORITY

This patent application claims the benefit of priority of U.S. Provisional Patent Application Ser. No. 62/343,330, which was filed May 31, 2016, and which is hereby incorporated herein by reference.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright 2016, Sabre Communications Corp., All Rights Reserved.

TECHNICAL FIELD

This document pertains generally, but not by way of limitation, to platforms such as for utility poles such as monopoles, such as for raised antenna implementations in the field.

BACKGROUND

Utility and communication poles can include monopoles that can be used to raise or support lights, communications equipment, or other devices above the surface to which they are mounted. Platforms can be mounted to the monopole, such as at an extended distance above the earth or other surface from which the monopole extends. A human worker may climb the monopole and stand on the platform. Equipment may be mounted to the platform.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present inventor has recognized, among other things, that structural integrity and the ability to accommodate variations in equipment sizes and mounting orientations to platforms can be important considerations.

Figure 1:
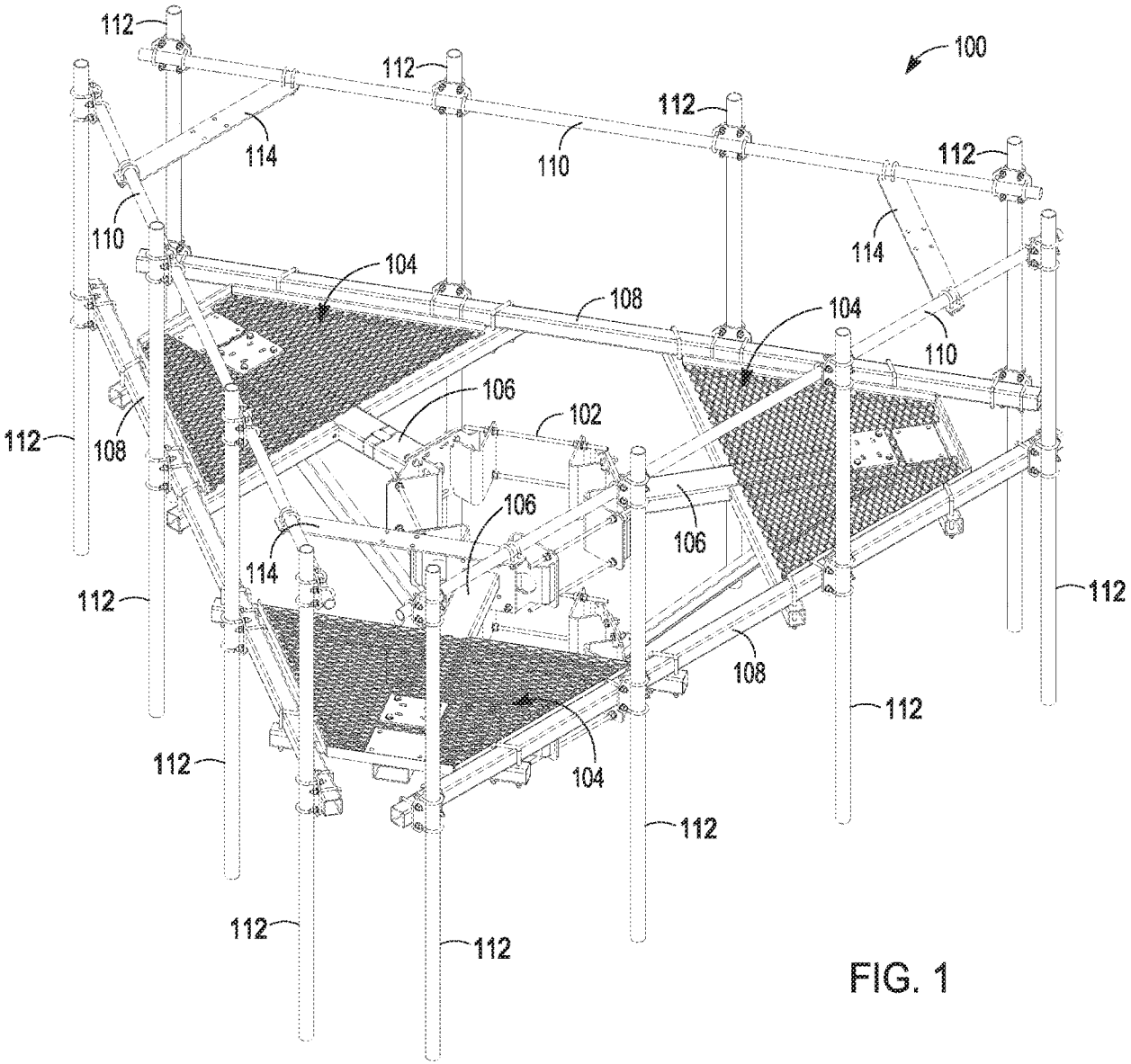
FIG. 1 is an example of a platform that can be mounted to a utility or communications monopole.

FIG. 1 shows an example of a platform assembly 100 such as can be mounted onto a utility monopole, such as via a bracket 102. In an example, the bracket 102 can include a collar, such as a tri-collar bracket assembly that can accommodate a 10 inch through 40 inch monopole extending there through. Any number (e.g., three) of platforms 104 can be mounted to the bracket 102, such as on arms 106 extending laterally and radially therefrom. The platforms 104 can respectively include a trapezoidal or other frame extending from the arms. A metal mesh or other flooring material can be welded or otherwise affixed to the frames of the platforms 104, such as to provide a floor or step that a human utility or communications worker can stand upon, such as while the communications worker is mounting communications or other equipment directly or indirectly to the monopole.

Adjacent platforms 104 can be connected and braced by square tube or other lower rails 108, which can be bolted to peripheral edges of the adjacent platforms, such as to form a triangle, such as shown in FIG. 1. A similar triangular arrangement of upper rails 110 can be located above corresponding lower rails 108. Vertical mounting pipes 112 can extend between the lower rails 108 and the corresponding upper rails 110, such as by being bolted thereto, such as using U-bolts, or otherwise. The vertical mounting pipes 112 can support the upper rails 110 above the corresponding lower rails 108. Corner connection plates 114 can be bolted between adjacent upper rails 110, such as using U-bolts or otherwise, such as to secure adjacent upper rails 110 to each other in their triangular arrangement.

One problem with the approach shown in FIG. 1 is that the vertical mounting pipes 112 are generally longer than the spacing between the upper rails 110 and the lower rails 108 and, therefore, may not be mounted at a consistent height with respect to the upper rails 110, the lower rails 108, or both. In addition, in many instances it is advantageous to have the center of the vertical mounting pipes 112 raised above the center of the lower rails 108. Such variations in the moments imposed by loading creates variable stresses than must be accommodated, preferably by adding as little weight as possible and as few components as possible.

Figure 2:
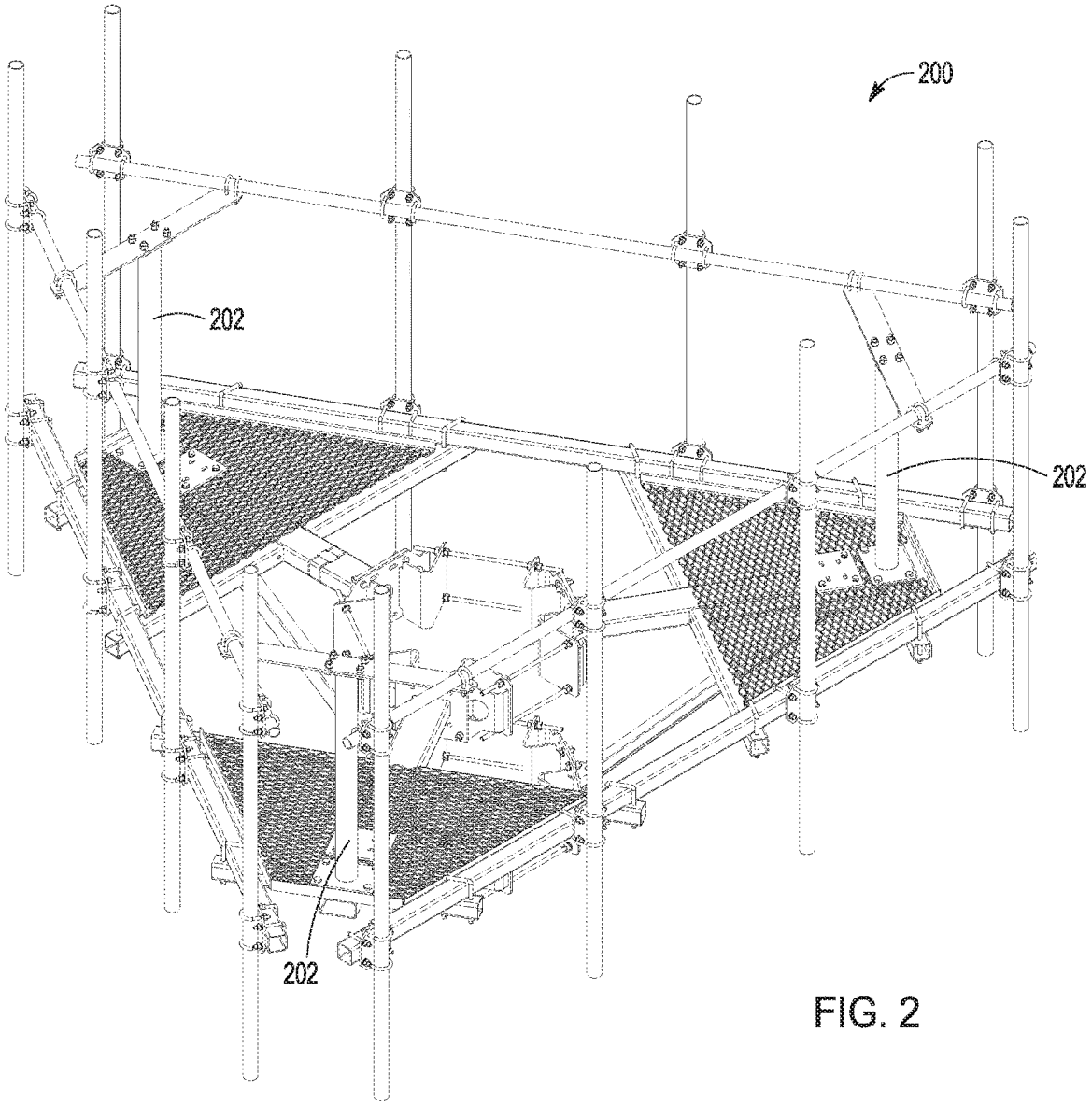
FIG. 2 is an example of such a platform that can include vertical corner pedestals to provide increased stability, and can accommodate variations in vertical locations of the mounting pipes extending between a triangular or other arrangement of lower rails and a similar triangular or other arrangement of upper rails.
Figure 3:
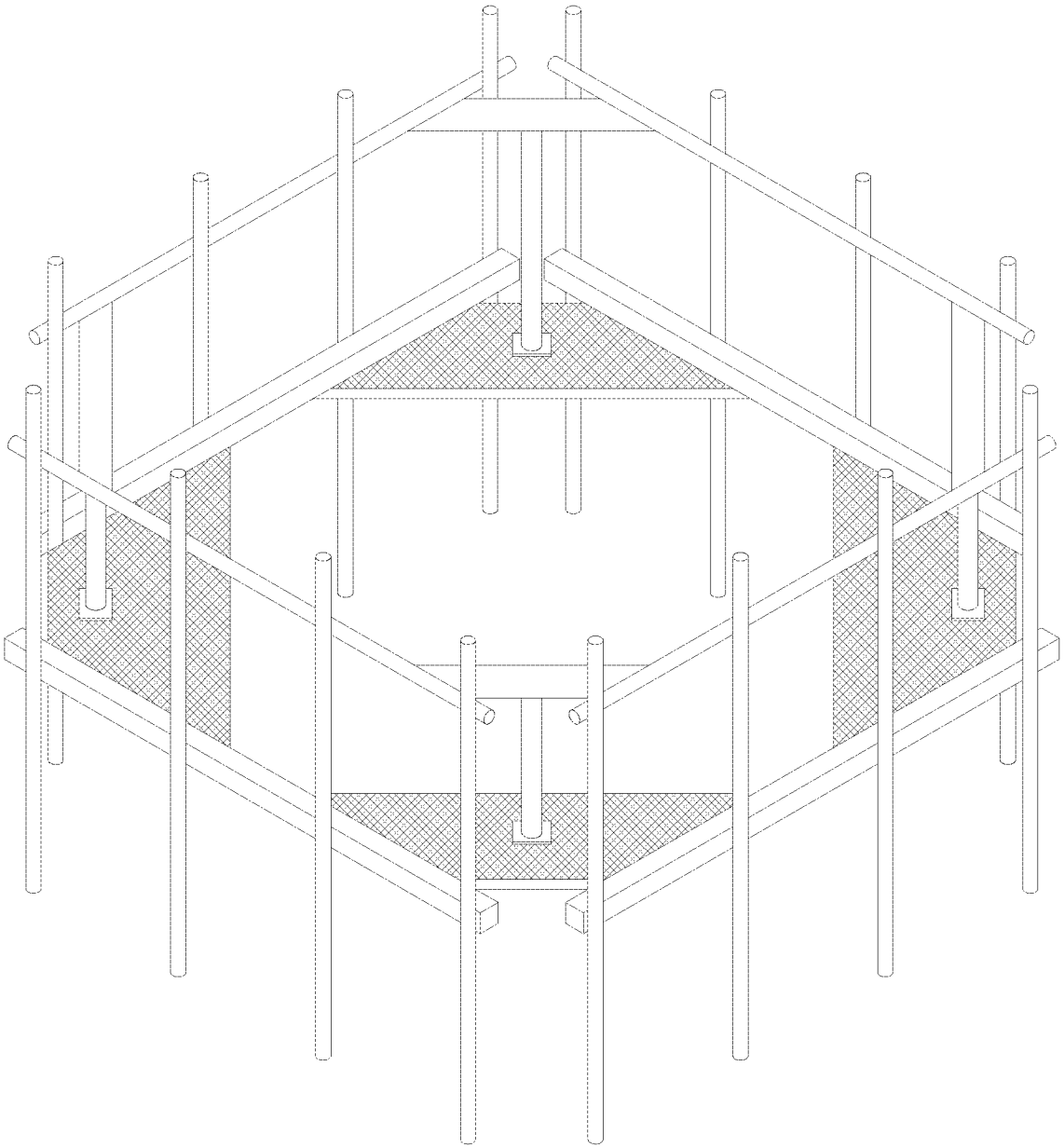
FIG. 3 is an example of an embodiment having at least the platforms, such as can include a fourth platform.

FIG. 2 shows an example of such additional components that can accomplish this objective. FIG. 2 shows an example of a platform assembly 200, similar to the platform assembly 100 shown in FIG. 1, but including a number (e.g., one or more of three) of vertical pedestals that can be bolted to and extend between respective platforms 104 and corresponding corner connection plates 114 that are located above such respective platforms 104. This can provide increased stability to the triangular arrangement of upper rails 110, which, in turn, can allow the platform assembly 200 to bear more equipment or other weight, including when there is variability in the height or vertical location of one or more of the individual vertical pipes 112. The arrangement shown in FIG. 2 can be implemented in a new instantiation of a platform assembly 200, or can be implemented as a retrofit of a platform assembly similar to that shown in FIG. 1, or the like.

The claimed invention is:

1. A platform assembly for a utility or communications monopole, the platform assembly comprising:

a central mounting bracket, configured for mounting about the monopole;

one or more supporting arms extending laterally from the central mounting bracket and including a first arm;

one or more platforms coupled to respective arms and including a first platform having first and second edges, wherein the first platform extends across the first arm;

a first lower rail, extending along and coupled to the first edge;

a first upper rail, parallel to and offset from the first lower rail;

a second lower rail, extending along and coupled to the second edge;

a second upper rail, parallel to and offset from the second lower rail;

a first plurality of vertical mounting pipes interconnecting the first upper rail to the first lower rail and supporting the first upper rail with respect to the first lower rail;

a second plurality of vertical mounting pipes interconnecting the second upper rail to the second lower rail and supporting the second upper rail with respect to the second lower rail;

a corner connection plate, extending between and directly connected to the first and second upper rails; and a vertical support pedestal connecting the corner connection plate to the first arm, wherein the vertical support pedestal supports and is directly connected to an underside of the corner connection plate, and the vertical support pedestal is mounted above a footprint of a portion of the first arm such that the vertical support pedestal is supported by the underlying first arm.

2. The platform assembly of claim 1, wherein the first lower rail is also coupled to a different individual platform of the one or more platforms.

3. The platform assembly of claim 1, wherein the one or more platforms includes a second platform having a first edge, and the first platform and the second platform are coupled to and thereby share the same first lower rail along the first edge of each of the first and second platforms.

4. The platform assembly of claim 3, wherein the first platform and the second platform are coupled to and thereby share the same first upper rail parallel to and offset from the same first lower rail, including coupling the first upper rail via the vertical support pedestal and the corner connection plate.

5. The platform assembly of claim 3, wherein the platforms include a third platform.

6. A platform assembly for a utility or communications monopole, the platform assembly comprising:

a central mounting bracket, configured for mounting about the monopole;

at least three supporting arms extending laterally from the central mounting bracket and including a first arm;

at least three platforms coupled to respective arms and including a first platform that extends across the first arm;

at least three lower rails, extending between adjacent pairs of the platforms;

at least three upper rails, located above respective lower rails;

a plurality of vertical mounting pipes interconnecting respective upper rails to corresponding lower rails, and supporting the respective upper rails with respect to the corresponding lower rails;

at least three corner connection plates, extending between and directly connected to respective adjacent upper rails; and a vertical support pedestal connecting an individual one of the corner connection plates to the first arm, wherein the vertical support pedestal supports and is directly connected an underside of to the individual corner connection plate, and the vertical support pedestal is mounted above a footprint of a portion of the first arm such that the vertical support pedestal is supported by the underside first arm.

* * * * *